US010102808B2

(12) United States Patent
Chaji

(10) Patent No.: US 10,102,808 B2
(45) Date of Patent: Oct. 16, 2018

(54) SYSTEMS AND METHODS OF MULTIPLE COLOR DRIVING

(71) Applicant: Ignis Innovation Inc., Waterloo (CA)

(72) Inventor: Gholamreza Chaji, Waterloo (CA)

(73) Assignee: Ignis Innovation Inc., Waterloo (CA)

( * ) Notice: Subject to any disclaimer, the term of this patent is extended or adjusted under 35 U.S.C. 154(b) by 183 days.

(21) Appl. No.: 15/293,526

(22) Filed: Oct. 14, 2016

(65) Prior Publication Data

US 2017/0110061 A1 Apr. 20, 2017

(30) Foreign Application Priority Data

Oct. 14, 2015 (CA) ..... 2908285

(51) Int. Cl.
*G09G 3/20* (2006.01)
*G09G 3/3291* (2016.01)

(52) U.S. Cl.
CPC ..... *G09G 3/3291* (2013.01); *G09G 3/2003* (2013.01); *G09G 2300/0452* (2013.01); *G09G 2310/027* (2013.01); *G09G 2310/0286* (2013.01); *G09G 2310/08* (2013.01)

(58) Field of Classification Search
None
See application file for complete search history.

(56) References Cited

U.S. PATENT DOCUMENTS 3,506,851 A 4/1970 Polkinghorn et al.
3,750,987 A 8/1973 Gobel
3,774,055 A 11/1973 Bapat et al.
4,090,096 A 5/1978 Nagami
4,354,162 A 10/1982 Wright
4,996,523 A 2/1991 Bell et al.
5,134,387 A 7/1992 Smith et al.
5,153,420 A 10/1992 Hack et al.
5,170,158 A 12/1992 Shinya
5,204,661 A 4/1993 Hack et al.
5,266,515 A 11/1993 Robb et al.
5,278,542 A 1/1994 Smith et al.
5,408,267 A 4/1995 Main
(Continued)

FOREIGN PATENT DOCUMENTS

AU 729652 6/1997
AU 764896 12/2001
(Continued)

OTHER PUBLICATIONS

Ahnood et al.: "Effect of threshold voltage instability on field effect mobility in thin film transistors deduced from constant current measurements"; dated Aug. 2009.
(Continued)

*Primary Examiner* — Kent Chang
*Assistant Examiner* — Benjamin Morales Fernande
(74) *Attorney, Agent, or Firm* — Nixon Peabody LLP

(57) ABSTRACT

Systems and methods of color data driving for light emissive visual display technology, and particularly to systems and methods for driving pixels with more than three primary color subpixels. Only a subset of the total number of subpixels per pixel are driven at any one time reducing the number of decoders/DACs. The decoders/DACs are coupled by a color decoder only to the active subpixels using a switching fabric.

20 Claims, 4 Drawing Sheets

(56) References Cited

U.S. PATENT DOCUMENTS 5,498,880 A 3/1996 Lee et al.
5,572,444 A 11/1996 Lentz et al.
5,589,847 A 12/1996 Lewis
5,619,033 A 4/1997 Weisfield
5,648,276 A 7/1997 Hara et al.
5,670,973 A 9/1997 Bassetti et al.
5,691,783 A 11/1997 Numao et al.
5,701,505 A 12/1997 Yamashita et al.
5,714,968 A 2/1998 Ikeda
5,744,824 A 4/1998 Kousai et al.
5,745,660 A 4/1998 Kolpatzik et al.
5,748,160 A 5/1998 Shieh et al.
5,758,129 A 5/1998 Gray et al.
5,835,376 A 11/1998 Smith et al.
5,870,071 A 2/1999 Kawahata
5,874,803 A 2/1999 Garbuzov et al.
5,880,582 A 3/1999 Sawada
5,903,248 A 5/1999 Irwin
5,917,280 A 6/1999 Burrows et al.
5,949,398 A 9/1999 Kim
5,952,789 A 9/1999 Stewart et al.
5,990,629 A 11/1999 Yamada et al.
6,023,259 A 2/2000 Howard et al.
6,069,365 A 5/2000 Chow et al.
6,091,203 A 7/2000 Kawashima et al.
6,097,360 A 8/2000 Holloman
6,100,868 A 8/2000 Lee et al.
6,144,222 A 11/2000 Ho
6,229,506 B1 5/2001 Dawson et al.
6,229,508 B1 5/2001 Kane
6,246,180 B1 6/2001 Nishigaki
6,252,248 B1 6/2001 Sano et al.
6,268,841 B1 7/2001 Cairns et al.
6,288,696 B1 9/2001 Holloman
6,307,322 B1 10/2001 Dawson et al.
6,310,962 B1 10/2001 Chung et al.
6,323,631 B1 11/2001 Juang
6,333,729 B1 12/2001 Ha
6,384,804 B1 5/2002 Dodabalapur et al.
6,388,653 B1 5/2002 Goto et al.
6,392,617 B1 5/2002 Gleason
6,396,469 B1 5/2002 Miwa et al.
6,414,661 B1 7/2002 Shen et al.
6,417,825 B1 7/2002 Stewart et al.
6,430,496 B1 8/2002 Smith et al.
6,433,488 B1 8/2002 Bu
6,473,065 B1 10/2002 Fan
6,475,845 B2 11/2002 Kimura
6,501,098 B2 12/2002 Yamazaki
6,501,466 B1 12/2002 Yamagashi et al.
6,522,315 B2 2/2003 Ozawa et al.
6,535,185 B2 3/2003 Kim et al.
6,542,138 B1 4/2003 Shannon et al.
6,559,839 B1 5/2003 Ueno et al.
6,580,408 B1 6/2003 Bae et al.
6,583,398 B2 6/2003 Harkin
6,618,030 B2 9/2003 Kane et al.
6,639,244 B1 10/2003 Yamazaki et al.
6,680,580 B1 1/2004 Sung
6,686,699 B2 2/2004 Yumoto
6,690,000 B1 2/2004 Muramatsu et al.
6,693,610 B2 2/2004 Shannon et al.
6,694,248 B2 2/2004 Smith et al.
6,697,057 B2 2/2004 Koyama et al.
6,724,151 B2 4/2004 Yoo
6,734,636 B2 5/2004 Sanford et al.
6,734,837 B1 * 5/2004 Havel ..... G01R 13/02 345/39
6,753,655 B2 6/2004 Shih et al.
6,753,834 B2 6/2004 Mikami et al.
6,756,741 B2 6/2004 Li
6,756,958 B2 6/2004 Furuhashi et al.
6,777,888 B2 8/2004 Kondo
6,781,567 B2 8/2004 Kimura
6,788,231 B1 9/2004 Hsueh
6,809,706 B2 10/2004 Shimoda
6,828,950 B2 12/2004 Koyama
6,858,991 B2 2/2005 Miyazawa
6,859,193 B1 2/2005 Yumoto
6,876,346 B2 4/2005 Anzai et al.
6,900,485 B2 5/2005 Lee
6,903,734 B2 6/2005 Eu
6,911,960 B1 6/2005 Yokoyama
6,911,964 B2 6/2005 Lee et al.
6,914,448 B2 7/2005 Jinno
6,919,871 B2 7/2005 Kwon
6,924,602 B2 8/2005 Komiya
6,937,220 B2 8/2005 Kitaura et al.
6,940,214 B1 9/2005 Komiya et al.
6,954,194 B2 10/2005 Matsumoto et al.
6,970,149 B2 11/2005 Chung et al.
6,975,142 B2 12/2005 Azami et al.
6,975,332 B2 12/2005 Arnold et al.
6,995,519 B2 2/2006 Arnold et al.
7,027,015 B2 4/2006 Booth, Jr. et al.
7,034,793 B2 4/2006 Sekiya et al.
7,038,392 B2 5/2006 Libsch et al.
7,057,588 B2 6/2006 Asano et al.
7,061,451 B2 6/2006 Kimura
7,071,932 B2 7/2006 Libsch et al.
7,106,285 B2 9/2006 Naugler
7,112,820 B2 9/2006 Chang et al.
7,113,864 B2 9/2006 Smith et al.
7,122,835 B1 10/2006 Ikeda et al.
7,129,914 B2 10/2006 Knapp et al.
7,164,417 B2 1/2007 Cok
7,224,332 B2 5/2007 Cok
7,248,236 B2 7/2007 Nathan et al.
7,259,737 B2 8/2007 Ono et al.
7,262,753 B2 8/2007 Tanghe et al.
7,274,363 B2 9/2007 Ishizuka et al.
7,310,092 B2 12/2007 Imamura
7,315,295 B2 1/2008 Kimura
7,317,434 B2 1/2008 Lan et al.
7,321,348 B2 1/2008 Cok et al.
7,327,357 B2 2/2008 Jeong
7,333,077 B2 2/2008 Koyama et al.
7,343,243 B2 3/2008 Smith et al.
7,414,600 B2 8/2008 Nathan et al.
7,466,166 B2 12/2008 Date et al.
7,495,501 B2 2/2009 Iwabuchi et al.
7,502,000 B2 3/2009 Yuki et al.
7,515,124 B2 4/2009 Yaguma et al.
7,535,449 B2 5/2009 Miyazawa
7,554,512 B2 6/2009 Steer
7,569,849 B2 8/2009 Nathan et al.
7,595,776 B2 9/2009 Hashimoto et al.
7,604,718 B2 10/2009 Zhang et al.
7,609,239 B2 10/2009 Chang
7,612,745 B2 11/2009 Yumoto et al.
7,619,594 B2 11/2009 Hu
7,619,597 B2 11/2009 Nathan et al.
7,639,211 B2 12/2009 Miyazawa
7,683,899 B2 3/2010 Hirakata et al.
7,688,289 B2 3/2010 Abe et al.
7,760,162 B2 7/2010 Miyazawa
7,808,008 B2 10/2010 Miyake
7,859,520 B2 12/2010 Kimura
7,889,159 B2 2/2011 Nathan et al.
7,903,127 B2 3/2011 Kwon
7,920,116 B2 4/2011 Woo et al.
7,944,414 B2 5/2011 Shirasaki et al.
7,978,170 B2 7/2011 Park et al.
7,989,392 B2 8/2011 Crockett et al.
7,995,008 B2 8/2011 Miwa
8,063,852 B2 11/2011 Kwak et al.
8,102,343 B2 1/2012 Yatabe
8,144,081 B2 3/2012 Miyazawa
8,159,007 B2 4/2012 Bama et al.
8,242,979 B2 8/2012 Anzai et al.
8,253,665 B2 8/2012 Nathan et al.
8,283,967 B2 10/2012 Chaji et al.
8,319,712 B2 11/2012 Nathan et al.
8,564,513 B2 10/2013 Nathan et al.

(56) References Cited

U.S. PATENT DOCUMENTS 8,872,739 B2 10/2014 Kimura
9,171,491 B1 * 10/2015 Kwon ..... G09G 3/3648
2001/0002703 A1 6/2001 Koyama
2001/0009283 A1 7/2001 Arao et al.
2001/0024186 A1 9/2001 Kane et al.
2001/0026257 A1 10/2001 Kimura
2001/0030323 A1 10/2001 Ikeda
2001/0035863 A1 11/2001 Kimura
2001/0040541 A1 11/2001 Yoneda et al.
2001/0043173 A1 11/2001 Troutman
2001/0045929 A1 11/2001 Prache
2001/0052940 A1 12/2001 Hagihara et al.
2002/0000576 A1 1/2002 Inukai
2002/0011796 A1 1/2002 Koyama
2002/0011799 A1 1/2002 Kimura
2002/0012057 A1 1/2002 Kimura
2002/0030190 A1 3/2002 Ohtani et al.
2002/0047565 A1 4/2002 Nara et al.
2002/0052086 A1 5/2002 Maeda
2002/0080108 A1 6/2002 Wang
2002/0084463 A1 7/2002 Sanford et al.
2002/0101172 A1 8/2002 Bu
2002/0117722 A1 8/2002 Osada et al.
2002/0140712 A1 10/2002 Ouchi et al.
2002/0158587 A1 10/2002 Komiya
2002/0158666 A1 10/2002 Azami et al.
2002/0158823 A1 10/2002 Zavracky et al.
2002/0171613 A1 11/2002 Goto et al.
2002/0181275 A1 12/2002 Yamazaki
2002/0186214 A1 12/2002 Siwinski
2002/0190971 A1 12/2002 Nakamura et al.
2002/0195967 A1 12/2002 Kim et al.
2002/0195968 A1 12/2002 Sanford et al.
2002/0196213 A1 12/2002 Akimoto et al.
2003/0001828 A1 1/2003 Asano
2003/0001858 A1 1/2003 Jack
2003/0016190 A1 1/2003 Kondo
2003/0020413 A1 1/2003 Oomura
2003/0030603 A1 2/2003 Shimoda
2003/0062524 A1 4/2003 Kimura
2003/0062844 A1 4/2003 Miyazawa
2003/0076048 A1 4/2003 Rutherford
2003/0090445 A1 5/2003 Chen et al.
2003/0090447 A1 5/2003 Kimura
2003/0090481 A1 5/2003 Kimura
2003/0095087 A1 5/2003 Libsch
2003/0098829 A1 5/2003 Chen et al.
2003/0107560 A1 6/2003 Yumoto et al.
2003/0107561 A1 6/2003 Uchino et al.
2003/0111966 A1 6/2003 Mikami et al.
2003/0112205 A1 6/2003 Yamada
2003/0112208 A1 6/2003 Okabe et al.
2003/0117348 A1 6/2003 Knapp et al.
2003/0122474 A1 7/2003 Lee
2003/0122747 A1 7/2003 Shannon et al.
2003/0128199 A1 7/2003 Kimura
2003/0151569 A1 8/2003 Lee et al.
2003/0156104 A1 8/2003 Morita
2003/0169241 A1 9/2003 LeChevalier
2003/0169247 A1 9/2003 Kawabe et al.
2003/0174152 A1 9/2003 Noguchi
2003/0179626 A1 9/2003 Sanford et al.
2003/0185438 A1 10/2003 Osawa et al.
2003/0189535 A1 10/2003 Matsumoto et al.
2003/0197663 A1 10/2003 Lee et al.
2003/0214465 A1 11/2003 Kimura
2003/0227262 A1 12/2003 Kwon
2003/0230141 A1 12/2003 Gilmour et al.
2003/0230980 A1 12/2003 Forrest et al.
2004/0004589 A1 1/2004 Shih
2004/0032382 A1 2/2004 Cok et al.
2004/0041750 A1 3/2004 Abe
2004/0066357 A1 4/2004 Kawasaki
2004/0070557 A1 4/2004 Asano et al.
2004/0070558 A1 4/2004 Cok
2004/0090186 A1 5/2004 Yoshida et al.
2004/0095338 A1 5/2004 Takashi
2004/0129933 A1 7/2004 Nathan et al.
2004/0130516 A1 7/2004 Nathan et al.
2004/0135749 A1 7/2004 Kondakov et al.
2004/0145547 A1 7/2004 Oh
2004/0150595 A1 8/2004 Kasai
2004/0155841 A1 8/2004 Kasai
2004/0171619 A1 9/2004 Barkoczy et al.
2004/0174349 A1 9/2004 Libsch
2004/0174354 A1 9/2004 Ono
2004/0183759 A1 9/2004 Stevenson et al.
2004/0189627 A1 9/2004 Shirasaki et al.
2004/0196275 A1 10/2004 Hattori
2004/0227697 A1 11/2004 Mori
2004/0239696 A1 12/2004 Okabe
2004/0251844 A1 12/2004 Hashido et al.
2004/0252085 A1 12/2004 Miyagawa
2004/0252089 A1 12/2004 Ono et al.
2004/0256617 A1 12/2004 Yamada et al.
2004/0257353 A1 12/2004 Imamura et al.
2004/0257355 A1 12/2004 Naugler
2004/0263437 A1 12/2004 Hattori
2005/0007357 A1 1/2005 Yamashita et al.
2005/0052379 A1 3/2005 Waterman
2005/0057459 A1 3/2005 Miyazawa
2005/0067970 A1 3/2005 Libsch et al.
2005/0067971 A1 3/2005 Kane
2005/0083270 A1 4/2005 Miyazawa
2005/0110420 A1 5/2005 Arnold et al.
2005/0110727 A1 5/2005 Shin
2005/0123193 A1 6/2005 Lamberg et al.
2005/0140600 A1 6/2005 Kim et al.
2005/0140610 A1 6/2005 Smith et al.
2005/0145891 A1 7/2005 Abe
2005/0156831 A1 7/2005 Yamazaki et al.
2005/0168416 A1 8/2005 Hashimoto et al.
2005/0206590 A1 9/2005 Sasaki et al.
2005/0212787 A1 9/2005 Noguchi et al.
2005/0219188 A1 10/2005 Kawabe et al.
2005/0243037 A1 11/2005 Eom et al.
2005/0248515 A1 11/2005 Naugler et al.
2005/0258867 A1 11/2005 Miyazawa
2005/0285822 A1 12/2005 Reddy et al.
2005/0285825 A1 12/2005 Eom et al.
2006/0012311 A1 1/2006 Ogawa
2006/0022305 A1 2/2006 Yamashita
2006/0038750 A1 2/2006 Inoue et al.
2006/0038758 A1 2/2006 Routley et al.
2006/0038762 A1 2/2006 Chou
2006/0066533 A1 3/2006 Sato et al.
2006/0077077 A1 4/2006 Kwon
2006/0077134 A1 4/2006 Hector
2006/0077194 A1 4/2006 Jeong
2006/0092185 A1 5/2006 Jo et al.
2006/0114196 A1 6/2006 Shin
2006/0125408 A1 6/2006 Nathan et al.
2006/0125740 A1 6/2006 Shirasaki et al.
2006/0139253 A1 6/2006 Choi et al.
2006/0145964 A1 7/2006 Park et al.
2006/0158402 A1 7/2006 Nathan
2006/0191178 A1 8/2006 Sempel et al.
2006/0208971 A1 9/2006 Deane
2006/0209012 A1 9/2006 Hagood, IV
2006/0214888 A1 9/2006 Schneider et al.
2006/0221009 A1 10/2006 Miwa
2006/0227082 A1 10/2006 Ogata et al.
2006/0232522 A1 10/2006 Roy et al.
2006/0244391 A1 11/2006 Shishido et al.
2006/0244697 A1 11/2006 Lee et al.
2006/0256053 A1 * 11/2006 Baek, II ..... G09G 3/3607
345/88
2006/0261841 A1 11/2006 Fish
2006/0279478 A1 12/2006 Ikegami
2006/0290614 A1 12/2006 Nathan et al.
2007/0001939 A1 1/2007 Hashimoto et al.
2007/0001945 A1 1/2007 Yoshida et al.
2007/0008251 A1 1/2007 Kohno et al.
2007/0008297 A1 1/2007 Bassetti

(56) References Cited

U.S. PATENT DOCUMENTS

| | | | |
|---|---|---|---|
| 2007/0035489 | A1 | 2/2007 | Lee |
| 2007/0035707 | A1 | 2/2007 | Margulis |
| 2007/0040773 | A1 | 2/2007 | Lee et al. |
| 2007/0040782 | A1 | 2/2007 | Woo et al. |
| 2007/0057873 | A1 | 3/2007 | Uchino et al. |
| 2007/0057874 | A1 | 3/2007 | Le Roy et al. |
| 2007/0063932 | A1 | 3/2007 | Nathan et al. |
| 2007/0075957 | A1 | 4/2007 | Chen |
| 2007/0080908 | A1 | 4/2007 | Nathan et al. |
| 2007/0085801 | A1 | 4/2007 | Park et al. |
| 2007/0109232 | A1 | 5/2007 | Yamamoto et al. |
| 2007/0128583 | A1 | 6/2007 | Miyazawa |
| 2007/0164941 | A1 | 7/2007 | Park et al. |
| 2007/0182671 | A1 | 8/2007 | Nathan et al. |
| 2007/0236430 | A1 | 10/2007 | Fish |
| 2007/0236440 | A1 | 10/2007 | Wacyk et al. |
| 2007/0241999 | A1 | 10/2007 | Lin |
| 2007/0242008 | A1 | 10/2007 | Cummings |
| 2008/0001544 | A1 | 1/2008 | Murakami et al. |
| 2008/0043044 | A1 | 2/2008 | Woo et al. |
| 2008/0048951 | A1 | 2/2008 | Naugler et al. |
| 2008/0055134 | A1 | 3/2008 | Li et al. |
| 2008/0062106 | A1 | 3/2008 | Tseng |
| 2008/0088549 | A1 | 4/2008 | Nathan et al. |
| 2008/0094426 | A1 | 4/2008 | Kimpe |
| 2008/0111766 | A1 | 5/2008 | Uchino et al. |
| 2008/0122819 | A1 | 5/2008 | Cho et al. |
| 2008/0074360 | A1 | 6/2008 | Lu et al. |
| 2008/0129906 | A1 | 6/2008 | Lin et al. |
| 2008/0198103 | A1 | 8/2008 | Toyomura et al. |
| 2008/0219232 | A1 | 9/2008 | Heubel et al. |
| 2008/0228562 | A1 | 9/2008 | Smith et al. |
| 2008/0231625 | A1 | 9/2008 | Minami et al. |
| 2008/0231641 | A1 | 9/2008 | Miyashita |
| 2008/0265786 | A1 | 10/2008 | Koyama |
| 2008/0290805 | A1 | 11/2008 | Yamada et al. |
| 2009/0009459 | A1 | 1/2009 | Miyashita |
| 2009/0015532 | A1 | 1/2009 | Katayama et al. |
| 2009/0058789 | A1 | 3/2009 | Hung et al. |
| 2009/0121988 | A1 | 5/2009 | Amo et al. |
| 2009/0146926 | A1 | 6/2009 | Sung et al. |
| 2009/0153448 | A1 | 6/2009 | Tomida et al. |
| 2009/0153459 | A9 | 6/2009 | Han et al. |
| 2009/0174628 | A1 | 7/2009 | Wang et al. |
| 2009/0201230 | A1 | 8/2009 | Smith |
| 2009/0201281 | A1 | 8/2009 | Routley et al. |
| 2009/0206764 | A1 | 8/2009 | Schemmann et al. |
| 2009/0225011 | A1 | 9/2009 | Choi |
| 2009/0244046 | A1 | 10/2009 | Seto |
| 2009/0251486 | A1 | 10/2009 | Sakakibara et al. |
| 2009/0278777 | A1 | 11/2009 | Wang et al. |
| 2009/0289964 | A1 | 11/2009 | Miyachi |
| 2009/0295423 | A1 | 12/2009 | Levey |
| 2010/0026725 | A1 | 2/2010 | Smith |
| 2010/0033469 | A1 | 2/2010 | Nathan |
| 2010/0039451 | A1 | 2/2010 | Jung |
| 2010/0039453 | A1 | 2/2010 | Nathan et al. |
| 2010/0045646 | A1 | 2/2010 | Kishi |
| 2010/0079419 | A1 | 4/2010 | Shibusawa |
| 2010/0134475 | A1 | 6/2010 | Ogura |
| 2010/0141564 | A1 | 6/2010 | Choi et al. |
| 2010/0207920 | A1 | 8/2010 | Chaji et al. |
| 2010/0225634 | A1 | 9/2010 | Levey et al. |
| 2010/0251295 | A1 | 9/2010 | Amento et al. |
| 2010/0269889 | A1 | 10/2010 | Reinhold et al. |
| 2010/0277400 | A1 | 11/2010 | Jeong |
| 2010/0315319 | A1 | 12/2010 | Cok et al. |
| 2010/0315449 | A1 | 12/2010 | Chaji |
| 2011/0050741 | A1 | 3/2011 | Jeong |
| 2011/0063197 | A1 | 3/2011 | Chung et al. |
| 2011/0069089 | A1 | 3/2011 | Kopf et al. |
| 2011/0074762 | A1 | 3/2011 | Shirasaki |
| 2011/0084993 | A1 | 4/2011 | Kawabe |
| 2011/0109350 | A1 | 5/2011 | Chaji et al. |
| 2011/0169805 | A1 | 7/2011 | Katsunori |
| 2011/0191042 | A1 | 8/2011 | Chaji |
| 2011/0205221 | A1 | 8/2011 | Lin |
| 2012/0026146 | A1 | 2/2012 | Kim |
| 2012/0169793 | A1 | 7/2012 | Nathan |
| 2012/0299976 | A1 | 11/2012 | Chen et al. |
| 2012/0299978 | A1 | 11/2012 | Chaji |
| 2014/0071189 | A1* | 3/2014 | Park ..... G09G 5/02 345/694 |
| 2014/0267215 | A1 | 9/2014 | Soni |
| 2015/0356901 | A1* | 12/2015 | Chen ..... G09G 3/2003 345/690 |
| 2016/0019851 | A1* | 1/2016 | Chen ..... G09G 3/3607 345/89 |

FOREIGN PATENT DOCUMENTS

| | | | |
|---|---|---|---|
| CA | 1 294 034 | | 1/1992 |
| CA | 2 249 592 | | 7/1998 |
| CA | 2 303 302 | | 3/1999 |
| CA | 2 368 386 | | 9/1999 |
| CA | 2 242 720 | | 1/2000 |
| CA | 2 354 018 | | 6/2000 |
| CA | 2 432 530 | | 7/2002 |
| CA | 2 436 451 | | 8/2002 |
| CA | 2 507 276 | | 8/2002 |
| CA | 2 463 653 | | 1/2004 |
| CA | 2 498 136 | | 3/2004 |
| CA | 2 522 396 | | 11/2004 |
| CA | 2 438 363 | | 2/2005 |
| CA | 2 443 206 | | 3/2005 |
| CA | 2 519 097 | | 3/2005 |
| CA | 2 472 671 | | 12/2005 |
| CA | 2 523 841 | | 1/2006 |
| CA | 2 567 076 | | 1/2006 |
| CA | 2 495 726 | | 7/2006 |
| CA | 2 557 713 | | 11/2006 |
| CA | 2 526 782 | C | 8/2007 |
| CA | 2 651 893 | | 11/2007 |
| CA | 2 672 590 | | 10/2009 |
| CN | 1601594 | A | 3/2005 |
| CN | 1886774 | | 12/2006 |
| CN | 101395653 | | 3/2009 |
| DE | 202006007613 | | 9/2006 |
| EP | 0 478 186 | | 4/1992 |
| EP | 1 028 471 | A | 8/2000 |
| EP | 1 130 565 | A1 | 9/2001 |
| EP | 1 194 013 | | 4/2002 |
| EP | 1 321 922 | | 6/2003 |
| EP | 1 335 430 | A1 | 8/2003 |
| EP | 1 381 019 | | 1/2004 |
| EP | 1 429 312 | A | 6/2004 |
| EP | 1 439 520 | A2 | 7/2004 |
| EP | 1 465 143 | A | 10/2004 |
| EP | 1 473 689 | A | 11/2004 |
| EP | 1 517 290 | A2 | 3/2005 |
| EP | 1 521 203 | A2 | 4/2005 |
| GB | 2 399 935 | | 9/2004 |
| GB | 2 460 018 | | 11/2009 |
| JP | 09 090405 | | 4/1997 |
| JP | 10-254410 | | 9/1998 |
| JP | 11 231805 | | 8/1999 |
| JP | 2002-278513 | | 9/2002 |
| JP | 2003-076331 | | 3/2003 |
| JP | 2003-099000 | | 4/2003 |
| JP | 2003-173165 | | 6/2003 |
| JP | 2003-186439 | | 7/2003 |
| JP | 2003-195809 | | 7/2003 |
| JP | 2003-271095 | | 9/2003 |
| JP | 2003-308046 | | 10/2003 |
| JP | 2004-054188 | | 2/2004 |
| JP | 2004-226960 | | 8/2004 |
| JP | 2005-004147 | | 1/2005 |
| JP | 2005-099715 | | 4/2005 |
| JP | 2005-258326 | | 9/2005 |
| JP | 2005-338819 | | 12/2005 |
| TW | 569173 | | 1/2004 |
| TW | 200526065 | | 8/2005 |
| TW | 1239501 | | 9/2005 |
| WO | WO 98/11554 | | 3/1998 |

(56) References Cited

FOREIGN PATENT DOCUMENTS

| | | | |
|---|---|---|---|
| WO | WO 99/48079 | | 9/1999 |
| WO | WO 01/27910 | A1 | 4/2001 |
| WO | WO 02/067327 | A | 8/2002 |
| WO | WO 03/034389 | | 4/2003 |
| WO | WO 03/063124 | | 7/2003 |
| WO | WO 03/075256 | | 9/2003 |
| WO | WO 2004/003877 | | 1/2004 |
| WO | WO 2004/015668 | A1 | 2/2004 |
| WO | WO 2004/034364 | | 4/2004 |
| WO | WO 2005/022498 | | 3/2005 |
| WO | WO 2005/055185 | | 6/2005 |
| WO | WO 2005/055186 | A1 | 6/2005 |
| WO | WO 2005/069267 | | 7/2005 |
| WO | WO 2005/122121 | | 12/2005 |
| WO | WO 2006/063448 | | 6/2006 |
| WO | WO 2006/128069 | | 11/2006 |
| WO | WO 2007/079572 | | 7/2007 |
| WO | WO 2008/057369 | | 5/2008 |
| WO | WO 2008/0290805 | | 11/2008 |
| WO | WO 2009/059028 | | 5/2009 |
| WO | WO 2009/127065 | | 10/2009 |
| WO | WO 2010/066030 | | 6/2010 |
| WO | WO 2010/120733 | | 10/2010 |

OTHER PUBLICATIONS

Alexander et al.: "Pixel circuits and drive schemes for glass and elastic AMOLED displays"; dated Jul. 2005 (9 pages).
Alexander et al.: "Unique Electrical Measurement Technology for Compensation Inspection and Process Diagnostics of AMOLED HDTV"; dated May 2010 (4 pages).
Ashtiani et al.: "AMOLED Pixel Circuit With Electronic Compensation of Luminance Degradation"; dated Mar. 2007 (4 pages).
Chaji et al.: "A Current-Mode Comparator for Digital Calibration of Amorphous Silicon AMOLED Displays"; dated Jul. 2008 (5 pages).
Chaji et al.: "A fast settling current driver based on the CCII for AMOLED displays"; dated Dec. 2009 (6 pages).
Chaji et al.: "A Low-Cost Stable Amorphous Silicon AMOLED Display with Full V~T- and V~O~L~E~D Shift Compensation"; dated May 2007 (4 pages).
Chaji et al.: "A low-power driving scheme for a-Si:H active-matrix organic light-emitting diode displays"; dated Jun. 2005 (4 pages).
Chaji et al.: "A low-power high-performance digital circuit for deep submicron technologies"; dated Jun. 2005 (4 pages).
Chaji et al.: "A novel a-Si:H AMOLED pixel circuit based on short-term stress stability of a-Si:H TFTs"; dated Oct. 2005 (3 pages).
Chaji et al.: "A Novel Driving Scheme and Pixel Circuit for AMOLED Displays"; dated Jun. 2006 (4 pages).
Chaji et al.: "A novel driving scheme for high-resolution large-area a-Si:H AMOLED displays"; dated Aug. 2005 (4 pages).
Chaji et al.: "A Stable Voltage-Programmed Pixel Circuit for a-Si:H AMOLED Displays"; dated Dec. 2006 (12 pages).
Chaji et al.: "A Sub-μA fast-settling current-programmed pixel circuit for AMOLED displays"; dated Sep. 2007.
Chaji et al.: "An Enhanced and Simplified Optical Feedback Pixel Circuit for AMOLED Displays"; dated Oct. 2006.
Chaji et al.: "Compensation technique for DC and transient instability of thin film transistor circuits for large-area devices"; dated Aug. 2008.
Chaji et al.: "Driving scheme for stable operation of 2-TFT a-Si AMOLED pixel"; dated Apr. 2005 (2 pages).
Chaji et al.: "Dynamic-effect compensating technique for stable a-Si:H AMOLED displays"; dated Aug. 2005 (4 pages).
Chaji et al.: "Electrical Compensation of OLED Luminance Degradation"; dated Dec. 2007 (3 pages).
Chaji et al.: "eUTDSP: a design study of a new VLIW-based DSP architecture"; dated May 2003 (4 pages).
Chaji et al.: "Fast and Offset-Leakage Insensitive Current-Mode Line Driver for Active Matrix Displays and Sensors"; dated Feb. 2009 (8 pages).
Chaji et al.: "High Speed Low Power Adder Design With a New Logic Style: Pseudo Dynamic Logic (SDL)"; dated Oct. 2001 (4 pages).
Chaji et al.: "High-precision fast current source for large-area current-programmed a-Si flat panels"; dated Sep. 2006 (4 pages).
Chaji et al.: "Low-Cost AMOLED Television with IGNIS Compensating Technology"; dated May 2008 (4 pages).
Chaji et al.: "Low-Cost Stable a-Si:H AMOLED Display for Portable Applications"; dated Jun. 2006 (4 pages).
Chaji et al.: "Low-Power Low-Cost Voltage-Programmed a-Si:H AMOLED Display"; dated Jun. 2008 (5 pages).
Chaji et al.: "Merged phototransistor pixel with enhanced near infrared response and flicker noise reduction for biomolecular imaging"; dated Nov. 2008 (3 pages).
Chaji et al.: "Parallel Addressing Scheme for Voltage-Programmed Active-Matrix OLED Displays"; dated May 2007 (6 pages).
Chaji et al.: "Pseudo dynamic logic (SDL): a high-speed and low-power dynamic logic family"; dated 2002 (4 pages).
Chaji et al.: "Stable a-Si:H circuits based on short-term stress stability of amorphous silicon thin film transistors"; dated May 2006 (4 pages).
Chaji et al.: "Stable Pixel Circuit for Small-Area High-Resolution a-Si:H AMOLED Displays"; dated Oct. 2008 (6 pages).
Chaji et al.: "Stable RGBW AMOLED display with OLED degradation compensation using electrical feedback"; dated Feb. 2010 (2 pages).
Chaji et al.: "Thin-Film Transistor Integration for Biomedical Imaging and AMOLED Displays"; dated May 2008 (177 pages).
Chapter 3: Color Spaces Keith Jack: Video Demystified: "A Handbook for the Digital Engineer" 2001 Referex ORD-0000-00-00 USA EP040425529 ISBN: 1-878707-56-6 pp. 32-33.
Chapter 8: Alternative Flat Panel Display 1-25 Technologies; Willem den Boer: "Active Matrix Liquid Crystal Display. Fundamentals and Applications" 2005 Referex ORD-0000-00-00 U.K.; XP040426102 ISBN: 0-7506-7813-5 pp. 206-209 p. 208.
European Partial Search Report Application No. 12 15 6251.6 European Patent Office dated May 30, 2012 (7 pages).
European Patent Office Communication Application No. 05 82 1114 dated Jan. 11, 2013 (9 pages).
European Patent Office Communication with Supplemental European Search Report for EP Application No. 07 70 1644.2 dated Aug. 18, 2009 (12 pages).
European Search Report Application No. 10 83 4294.0-1903 dated Apr. 8, 2013 (9 pages).
European Search Report Application No. EP 05 80 7905 dated Apr. 2, 2009 (5 pages).
European Search Report Application No. EP 05 82 1114 dated Mar. 27, 2009 (2 pages).
European Search Report Application No. EP 07 70 1644 dated Aug. 5, 2009.
European Search Report Application No. EP 10 17 5764 dated Oct. 18, 2010.
European Search Report Application No. EP 10 82 9593.2 European Patent Office dated May 17, 2013 (7 pages).
European Search Report Application No. EP 12 15 6251.6 European Patent Office dated Oct. 12, 2012 (18 pages).
European Search Report Application No. EP. 11 175 225.9 dated Nov. 4, 2011 (9 pages).
European Supplementary Search Report Application No. EP 09 80 2309 dated May 8, 2011 (14 pages).
European Supplementary Search Report Application No. EP 09 83 1339.8 dated Mar. 26, 2012 (11 pages).
Extended European Search Report Application No. EP 06 75 2777.0 dated Dec. 6, 2010 (21 pages).
Extended European Search Report Application No. EP 09 73 2338.0 dated May 24, 2011 (8 pages).
Extended European Search Report Application No. EP 11 17 5223, 4 dated Nov. 8, 2011 (8 pages).
Extended European Search Report Application No. EP 12 17 4465.0 European Patent Office dated Sep. 7, 2012 (9 pages).
Fan et al. "LTPS_TFT Pixel Circuit Compensation for TFT Threshold Voltage Shift and IR-Drop on the Power Line for Amolded Displays" 5 pages copyright 2012.

(56) References Cited

OTHER PUBLICATIONS

Goh et al. "A New a-Si:H Thin-Film Transistor Pixel Circuit for Active-Matrix Organic Light-Emitting Diodes" IEEE Electron Device Letters vol. 24 No. 9 Sep. 2003 pp. 583-585.
International Search Report Application No. PCT/CA2005/001844 dated Mar. 28, 2006 (2 pages).
International Search Report Application No. PCT/CA2006/000941 dated Oct. 3, 2006 (2 pages).
International Search Report Application No. PCT/CA2007/000013 dated May 7, 2007.
International Search Report Application No. PCT/CA2009/001049 dated Dec. 7, 2009 (4 pages).
International Search Report Application No. PCT/CA2009/001769 dated Apr. 8, 2010.
International Search Report Application No. PCT/IB2010/002898 Canadian Intellectual Property Office dated Jul. 28, 2009 (5 pages).
International Search Report Application No. PCT/IB2010/055481 dated Apr. 7, 2011 (3 pages).
International Search Report Application No. PCT/IB2011/051103 dated Jul. 8, 2011 3 pages.
International Search Report Application No. PCT/IB2012/052651 5 pages dated Sep. 11, 2012.
International Searching Authority Written Opinion Application No. PCT/IB2010/055481 dated Apr. 7, 2011 (6 pages).
International Searching Authority Written Opinion Application No. PCT/IB2012/052651 6 pages dated Sep. 11, 2012.
International Searching Authority Written Opinion Application No. PCT/IB2011/051103 dated Jul. 8, 2011 6 pages.
International Searching Authority Written Opinion Application No. PCT/IB2010/002898 Canadian Intellectual Property Office dated Mar. 30, 2011 (8 pages).
International Searching Authority Written Opinion Application No. PCT/CA2009/001769 dated Apr. 8, 2010 (8 pages).
Jafarabadiashtiani et al.: "A New Driving Method for a-Si AMOLED Displays Based on Voltage Feedback"; dated May 2005 (4 pages).
Lee et al.: "Ambipolar Thin-Film Transistors Fabricated by PECVD Nanocrystalline Silicon"; dated May 2006 (6 pages).
Ma e y et al: "Organic Light-Emitting Diode/Thin Film Transistor Integration for foldable Displays" Conference record of the 1997 International display research conference and international workshops on LCD technology and emissive technology. Toronto Sep. 15-19, 1997 (6 pages).
Matsueda y et al.: "35.1: 2.5-in. AMOLED with Integrated 6-bit Gamma Compensated Digital Data Driver"; dated May 2004 (4 pages).
Nathan et al. "Amorphous Silicon Thin Film Transistor Circuit Integration for Organic LED Displays on Glass and Plastic" IEEE Journal of Solid-State Circuits vol. 39 No. 9 Sep. 2004 pp. 1477-1486.
Nathan et al.: "Backplane Requirements for Active Matrix Organic Light Emitting Diode Displays"; dated Sep. 2006 (16 pages).
Nathan et al.: "Call for papers second international workshop on compact thin-film transistor (TFT) modeling for circuit simulation"; dated Sep. 2009 (1 page).
Nathan et al.: "Driving schemes for a-Si and LTPS AMOLED displays"; dated Dec. 2005 (11 pages).
Nathan et al.: "Invited Paper: a-Si for AMOLED—Meeting the Performance and Cost Demands of Display Applications (Cell Phone to HDTV)"; dated Jun. 2006 (4 pages).
Nathan et al.: "Thin film imaging technology on glass and plastic"; dated Oct. 31-Nov. 2, 2000 (4 pages).
Ono et al. "Shared Pixel Compensation Circuit for AM-OLED Displays" Proceedings of the 9th Asian Symposium on Information Display (ASID) pp. 462-465 New Delhi dated Oct. 8-12, 2006 (4 pages).
Philipp: "Charge transfer sensing" Sensor Review vol. 19 No. 2 Dec. 31, 1999 (Dec. 31, 1999) 10 pages.
Rafati et al.: "Comparison of a 17 b multiplier in Dual-rail domino and in Dual-rail D L (D L) logic styles"; dated 2002 (4 pages).
Safavaian et al.: "Three-TFT image sensor for real-time digital X-ray imaging"; dated Feb. 2, 2006 (2 pages).
Safavian et al.: "3-TFT active pixel sensor with correlated double sampling readout circuit for real-time medical x-ray imaging"; dated Jun. 2006 (4 pages).
Safavian et al.: "A novel current scaling active pixel sensor with correlated double sampling readout circuit for real time medical x-ray imaging"; dated May 2007 (7 pages).
Safavian et al.: "A novel hybrid active-passive pixel with correlated double sampling CMOS readout circuit for medical x-ray imaging"; dated May 2008 (4 pages).
Safavian et al.: "Self-compensated a-Si:H detector with current-mode readout circuit for digital X-ray fluoroscopy"; dated Aug. 2005 (4 pages).
Safavian et al.: "TFT active image sensor with current-mode readout circuit for digital x-ray fluoroscopy [5969D-82]"; dated Sep. 2005 (9 pages).
Smith, Lindsay I., "A tutorial on Principal Components Analysis," dated Feb. 26, 2001 (27 pages).
Stewart M. et al. "Polysilicon TFT technology for active matrix OLED displays" IEEE transactions on electron devices vol. 48 No. 5 May 2001 (7 pages).
Vygranenko et al.: "Stability of indium-oxide thin-film transistors by reactive ion beam assisted deposition"; dated Feb. 2009.
Wang et al.: "Indium oxides by reactive ion beam assisted evaporation: From material study to device application," dated Mar. 2009 (6 pages).
Yi He et al. "Current-Source a-Si:H Thin Film Transistor Circuit for Active-Matrix Organic Light-Emitting Displays" IEEE Electron Device Letters vol. 21 No. 12 Dec. 2000 pp. 590-592.
International Search Report Application No. PCT/IB2013/059074, dated Dec. 18, 2013 (5 pages).
International Searching Authority Written Opinion Application No. PCT/IB2013/059074, dated Dec. 18, 2013 (8 pages ).
Extended European Search Report Application No. EP 15173106.4 dated Oct. 15, 2013 (8 pages).

* cited by examiner

SYSTEMS AND METHODS OF MULTIPLE COLOR DRIVING

PRIORITY CLAIM

This application claims priority to Canadian Application No. 2,908,285, filed Oct. 14, 2015, which is hereby incorporated by reference herein in its entirety.

FIELD OF THE INVENTION

The present disclosure relates to color data driving for light emissive visual display technology, and particularly to systems and methods for driving pixels with more than three primary color subpixels in an active matrix light emitting diode device (AMOLED) and other emissive displays.

BRIEF SUMMARY

According to one aspect, there is provided a color data driver for an emissive display system having pixels, each pixel having a number of primary color subpixels, each primary color subpixel having a light emitting device, the color data driver comprising: data storage for receiving color data for a number of active primary color subpixels of a pixel, the number of active primary color subpixels less than a number of primary color subpixels of the pixel; decoders for performing digital to analog conversion of the color data to generate analog color data, the number of decoders corresponding to a preset maximum number of active primary color subpixels of a pixel which is less than the number of primary color subpixels of the pixel; and a color decoder for receiving the analog color data for the number of active primary color subpixels and for providing the color data for the active primary color subpixels to the pixel, the color decoder comprising: a switch fabric controllable to select a switching state being a combination of switching from color data inputs of the color decoder to color data outputs of the color decoder with use of color bits provided to the color decoder, the switch fabric for, according to the switching state, switching to each color data output one of at least one color data input, and for switching to at least one color data output, one of at least two color data inputs.

In some embodiments, the switch fabric comprises a set of switches for connecting to at least one bias voltage, color data outputs which are not being used for providing to the pixel the color data for the active primary color subpixels. In some embodiments, the at least one bias voltage comprises a different bias voltage for each color data output.

In some embodiments, the color bits uniquely identifies the switching state from a number of preset possible states, the bit length of the color bits corresponding to a shortest bit length required to select any of the switching states from the number of preset possible states. In some embodiments, the number of present possible states is two and the bit length of the color bits is one.

In some embodiments, the number of active primary color subpixels is three, the preset maximum number of active primary color subpixels of a pixel is three, and the number of primary color subpixels of the pixel is four. In some embodiments, the primary color subpixels of the pixel consist of a red subpixel, a green subpixel, a blue subpixel, and a white subpixel. In some embodiments, the color bits uniquely identifies the switching state from four preset possible states and the bit length of the color bits is two, and wherein the switch fabric comprises a set of switches for connecting to at least one bias voltage, color data outputs which are not being used for providing to the pixel the color data for the active primary color subpixels.

In some embodiments, the color decoder receives the analog color data from the decoders via buffers, the number of buffers corresponding to the number of decoders.

In some embodiments, wherein the data storage comprises a switch register for storing the color data and the color bits, and for providing the color bits to the color decoder.

According to another aspect there is provided, a method of data driving for an emissive display system having pixels, each pixel having a number of primary color subpixels, each primary color subpixel having a light emitting device, the method comprising: receiving color data for a number of active primary color subpixels of a pixel, the number of active primary color subpixels less than a number of primary color subpixels of the pixel; performing digital to analog conversion of the color data to generate analog color data using decoders, the number of decoders corresponding to a preset maximum number of active primary color subpixels of a pixel which is less than the number of primary color subpixels of the pixel; receiving by a color decoder the analog color data for the number of active primary color subpixels; and providing by the color decoder the color data for the active primary color subpixels to the pixel with use of a switch fabric, the providing comprising: selecting a switching state being a combination of switching from color data inputs of the color decoder to color data outputs of the color decoder with use of color bits provided to the color decoder; according to the switching state, switching to each color data output one of at least one color data input; and according to the switching state, switching to at least one color data output, one of at least two color data inputs.

In some embodiments, the step of providing further comprises: according to the switching state, connecting to at least one bias voltage, color data outputs which are not being used for providing to the pixel the color data for the active primary color subpixels. In some embodiments, the at least one bias voltage comprises a different bias voltage for each color data output.

In some embodiments, the color bits uniquely identifies the switching state from four preset possible states and the bit length of the color bits is two, and wherein the step of providing further comprises: connecting to at least one bias voltage, color data outputs which are not being used for providing to the pixel the color data for the active primary color subpixels.

In some embodiments, the receiving by the color decoder of the analog color data from the decoders is via buffers, the method further comprising: receiving by buffers the analog color data from the decoders, the number of buffers corresponding to the number of decoders.

Some embodiments further provide for: storing the color data and the color bits in a switch register; and providing the color bits from the switch register to the color decoder.

The foregoing and additional aspects and embodiments of the present disclosure will be apparent to those of ordinary skill in the art in view of the detailed description of various embodiments and/or aspects, which is made with reference to the drawings, a brief description of which is provided next.

BRIEF DESCRIPTION OF THE DRAWINGS

The foregoing and other advantages of the disclosure will become apparent upon reading the following detailed description and upon reference to the drawings.

Figure 1A:
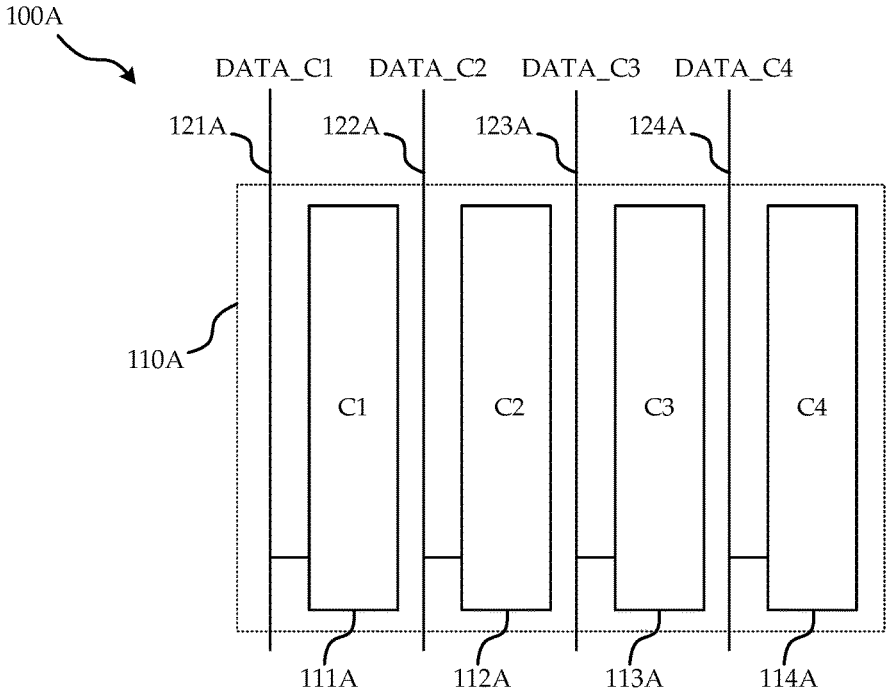
FIG. 1A (PRIOR ART)
FIG. 1A illustrates a known pixel with more than three primary color subpixels.

While the present disclosure is susceptible to various modifications and alternative forms, specific embodiments or implementations have been shown by way of example in the drawings and will be described in detail herein. It should be understood, however, that the disclosure is not intended to be limited to the particular forms disclosed. Rather, the disclosure is to cover all modifications, equivalents, and alternatives falling within the spirit and scope of an invention as defined by the appended claims.

DETAILED DESCRIPTION

For several reasons such as ease of manufacturing, wider color gamut, lower power consumption, among others, it is often preferred to use more than three primary color subpixels. In one example, each pixel consists of red, green, blue and white subpixels. FIG. 1A depicts a known pixel 100A with four primary color subpixels, 111A (C1), 112A (C2), 113A (C3), and 114A (C4), where primary colors C1, C2, C3, and C4, correspond, for example, to red, green, blue and white respectively. In such a case, the data is converted from RGB to RGBW at the image processors or at the controller or timing controller (TCON) and then passed to the data driver. As a result, each driver channel for a pixel requires at least four outputs to the pixel (in other cases it may require more outputs depending upon the number of primary color subpixels). For example, in FIG. 1A, red data is output over data line DATA_C1 121A, green data is output over data line DATA_C2 122A, blue data is output over data line DATA_C3 123A, and white data is output over data line DATA_C4 124A.

Figure 1B:
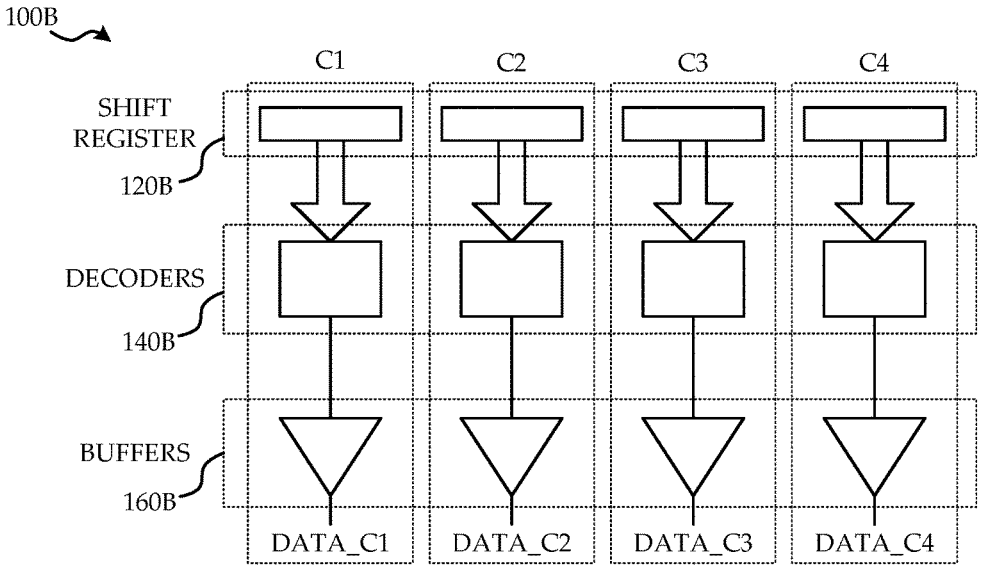
FIG. 1B (PRIOR ART)
FIG. 1B illustrates known multiple color driving of a pixel with more than three primary color subpixels.

FIG. 1B shows an example of a known driver channel 100B for a 4-subpixel pixel structure such as that illustrated in FIG. 1. The driver channel 100B consists of four parallel channels, one for each primary color C1, C2, C3, and C4, each utilizing a portion of shift registers 120B, decoders 140B, and buffers 160B. The digital data is passed to the data driver through shift registers 120B or through a combination of shift registers and latches. The digital data is converted into the analog domain through DACs (digital to analog converters) of which the decoders 140B comprise. The converted analog voltage is used to drive the panel through buffers 160B. The output of the buffers DATA_C1, DATA_C2, DATA_C3, and DATA_C4, constitute the primary color data which is input to a pixel such as that depicted in FIG. 1A.

The main issue with this structure and method of driving is that the data transfer rate to the data driver is increased by an amount corresponding to the number of extra primary colors. In the case of using an RGBW structure, the data rate is 25% more than the typical RGB data driver. This is more of a challenge in the case of higher resolution displays and higher frame rates. For a 4K display running at 120Hz, the data rate is 3.7 GB/s using an RGB structure, while the date rate for the same display is 4.9 GB/s using RGBW. Another challenge of known systems using RGBW versus RGB is that the size of the driver increases by 25% causing more cost and power consumption.

Providing in accordance with known driving techniques, a parallel and additional channel for every primary color beyond three leads to a proportional increase in data rate, driver size, increasing costs and power consumption.

While the embodiments described herein below are in the context of AMOLED displays it should be understood that the systems and methods described herein are applicable to any other display comprising pixels having more than three primary color subpixels, including but not limited to light emitting diode displays (LED), electroluminescent displays (ELD), organic light emitting diode displays (OLED), plasma display panels (PSP), among other displays.

It should be understood that the embodiments described herein pertain to systems and methods of driving are not limited to any particular display technology underlying their operation and the operation of the displays in which they are implemented. The systems and methods described herein are applicable to any number of various types and implementations of various visual display technologies.

Figure 2:
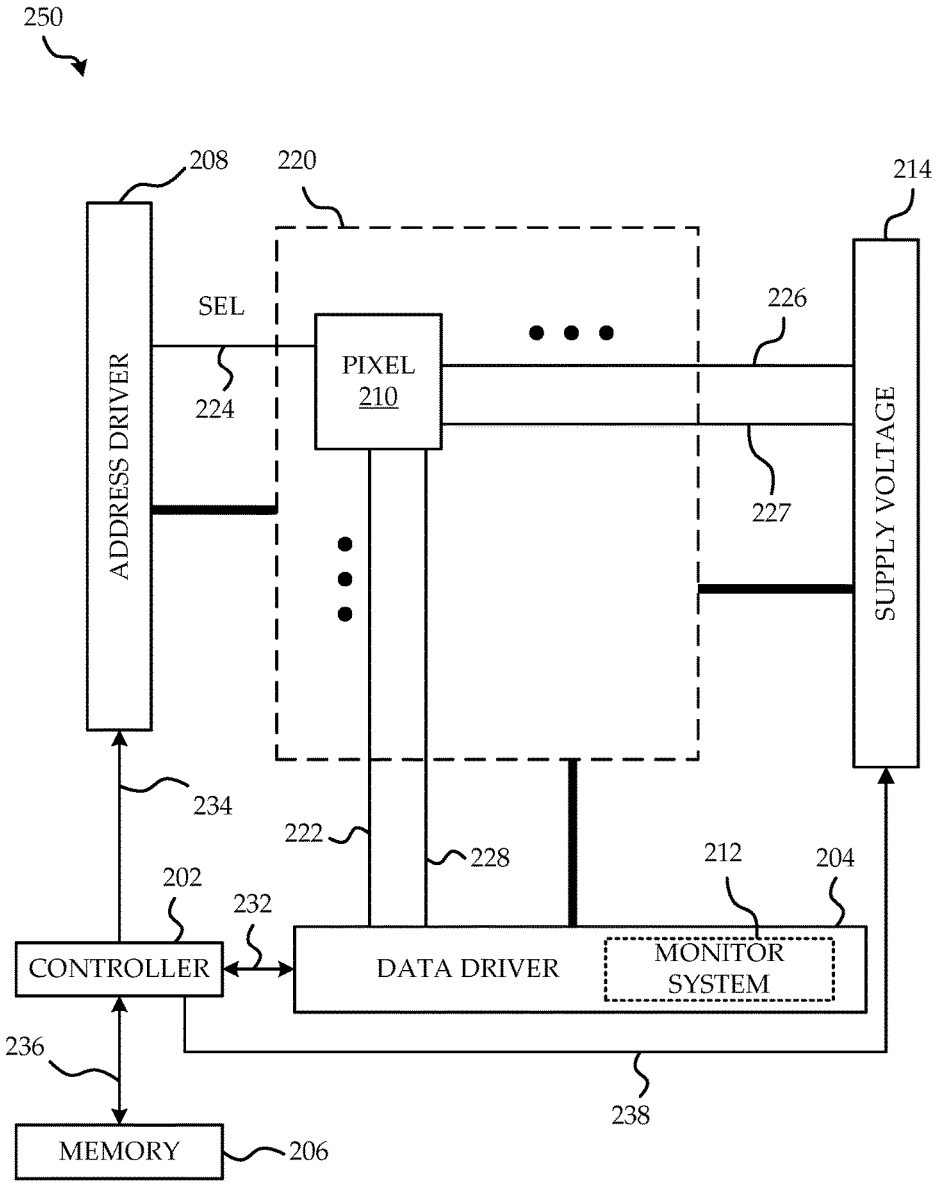
FIG. 2 illustrates an example display system which participates in and whose pixels are to be driven with use of the color driving systems and methods disclosed.

FIG. 2 is a diagram of an example display system 250 implementing systems and methods described further below. The display system 250 includes a display panel 220, an address driver 208, a data driver 204, a controller 202, and a memory storage 206.

The display panel 220 includes an array of pixels 210 (only one explicitly shown) arranged in rows and columns. Each of the pixels 210 is individually programmable to emit light with individually programmable luminance values. The controller 202 receives digital data indicative of information to be displayed on the display panel 220. The controller 202 sends signals 232 to the data driver 204 and scheduling signals 234 to the address driver 208 to drive the pixels 210 in the display panel 220 to display the information indicated. The plurality of pixels 210 of the display panel 220 thus comprise a display array or display screen adapted to dynamically display information according to the input digital data received by the controller 202. The display screen can display images and streams of video information from data received by the controller 202. The supply voltage 214 provides a constant power voltage or can serve as an adjustable voltage supply that is controlled by signals from the controller 202. The display system 250 can also incorporate features from a current source or sink (not shown) to provide biasing currents to the pixels 210 in the display panel 220 to thereby decrease programming time for the pixels 210.

For illustrative purposes, only one pixel 210 is explicitly shown in the display system 250 in FIG. 2. It is understood that the display system 250 is implemented with a display screen that includes an array of a plurality of pixels, such as the pixel 210, and that the display screen is not limited to a particular number of rows and columns of pixels. For example, the display system 250 can be implemented with a display screen with a number of rows and columns of pixels commonly available in displays for mobile devices, monitor-based devices, and/or projection-devices. In a multichannel or color display, a number of different types of pixels, each responsible for reproducing color of a particular channel or color such as red, green, blue, or white will be present in the display. Pixels of this kind may also be referred to as "subpixels" as a group of them collectively provide a desired color at a particular row and column of the display, which group of subpixels may collectively also be referred to as a "pixel".

The subpixels of the pixel 210 are operated by a driving circuit or pixel circuit that generally includes a driving transistor and a light emitting device. The light emitting device can optionally be an organic light emitting diode, but implementations of the present disclosure apply to pixel circuits having other electroluminescence devices, including current-driven light emitting devices and those listed above. The driving transistor in the pixel 210 can optionally be an n-type or p-type amorphous silicon thin-film transistor, but implementations of the present disclosure are not limited to pixel circuits having a particular polarity of transistor or only to pixel circuits having thin-film transistors. The pixel circuit 210 can also include a storage capacitor for storing programming information and allowing the pixel circuit 210 to drive the light emitting device after being addressed. Thus, the display panel 220 can be an active matrix display array.

As illustrated in FIG. 2, the pixel 210 illustrated as the top-left pixel in the display panel 220 is coupled to a select lines 224, a supply line 226, a data lines 222, and a monitor line 228. A read line may also be included for controlling connections to the monitor line. In one implementation, the supply voltage 214 can also provide a second supply line to the pixel 210. For example, each pixel can be coupled to a first supply line 226 charged with Vdd and a second supply line 227 coupled with Vss, and the pixel circuits 210 can be situated between the first and second supply lines to facilitate driving current between the two supply lines during an emission phase of the pixel circuit. It is to be understood that each of the pixels 210 in the pixel array of the display 220 is coupled to appropriate select lines, supply lines, data lines, and monitor lines. It is noted that aspects of the present disclosure apply to pixels having additional connections, such as connections to additional select lines, and to pixels having fewer connections.

With reference to the pixel 210 of the display panel 220, the select lines 224 is provided by the address driver 208, and can be utilized to enable, for example, a programming operation of the pixel 210 by activating a switch or transistor to allow the data lines 222 to program the various subpixels of the pixel 210. The data lines 222 convey programming information from the data driver 204 to the pixel 210. For example, the data lines 222 can be utilized to apply programming voltages or programming current to the subpixels of the pixel 210 in order to program the subpixels of the pixel 210 to emit a desired amount of luminance. The programming voltages (or programming current) supplied by the data driver 204 via the data lines 222 are voltages (or currents) appropriate to cause the subpixels of the pixel 210 to emit light with a desired amount of luminance according to the digital data received by the controller 202. The programming voltages (or programming currents) can be applied to the subpixels of the pixel 210 during a programming operation of the pixel 210 so as to charge storage devices within the subpixels of the pixel 210, such as a storage capacitor, thereby enabling the subpixels of the pixel 210 to emit light with the desired amount of luminance during an emission operation following the programming operation. For example, the storage device in a subpixel of the pixel 210 can be charged during a programming operation to apply a voltage to one or more of a gate or a source terminal of the driving transistor during the emission operation, thereby causing the driving transistor to convey the driving current through the light emitting device according to the voltage stored on the storage device.

Generally, in each subpixel of the pixel 210, the driving current that is conveyed through the light emitting device by the driving transistor during the emission operation of the pixel 210 is a current that is supplied by the first supply line 226 and is drained to a second supply line 227. The first supply line 226 and the second supply line 227 are coupled to the voltage supply 214. The first supply line 226 can provide a positive supply voltage (e.g., the voltage commonly referred to in circuit design as "Vdd") and the second supply line 227 can provide a negative supply voltage (e.g., the voltage commonly referred to in circuit design as "Vss"). Implementations of the present disclosure can be realized where one or the other of the supply lines (e.g., the supply line 227) is fixed at a ground voltage or at another reference voltage.

The display system 250 also includes a monitoring system 212. With reference again to the pixel 210 of the display panel 220, the monitor line 228 connects the pixel 210 to the monitoring system 212. The monitoring system 212 can be integrated with the data driver 204, or can be a separate stand-alone system. In particular, the monitoring system 212 can optionally be implemented by monitoring the current and/or voltage of the data line 222 during a monitoring operation of the pixel 210, and the separate monitor line 228 can be entirely omitted.

Figure 3:
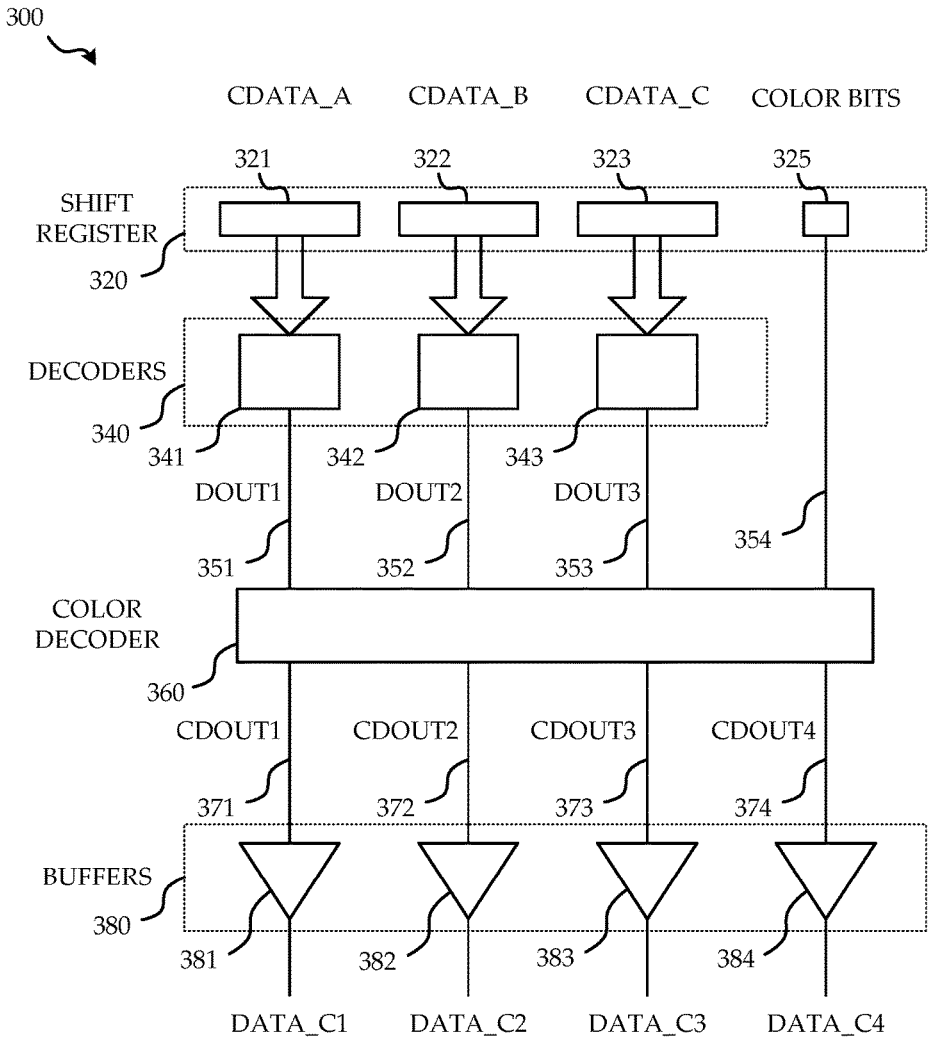
FIG. 3 illustrates a multiple color data driver according to an embodiment.

Referring to FIG. 3, a multiple color data driver 300 according to an embodiment will now be described. The data driver 300 and associated methods address the challenges associated with the use of extra color output for a pixel i.e. for dealing with pixels having more than four primary color subpixels. In most of cases, only a subset of the primary color subpixels are active for each color mapping. For example, a color mapping from RGB to RGBW by the image processors or the controller for any particular color might only use three (or possibly fewer) of the primary color subpixels R, G, B, and W. In such a case, the number of outputs of the data driver 300 for a channel, corresponding to the number of primary color subpixels of a pixel in a column, is more than the total number of active primary color subpixels emitting light, at any one time, which in the case illustrated is three (or less). The data driver 300 therefore, uses fewer decoders 341, 342, 343, and hence fewer DACs along with a color decoder 360, described below, in order to provide color data signals to all the primary color subpixels of a pixel only as required. Once a maximum number S of simultaneously active primary color subpixels per pixel is determined, for example as illustrated S=3, this number is used to define the number of decoders and hence DACs for each pixel. The color decoder 360 is used to align each of the DACs outputs to different outputs depending on the color value. The color decoder 360 can use the data passed to the source driver by the TCON or the image processor to align the DACs or it can calculate the DACs' status by itself based on color values.

FIG. 3 shows an example of data driver 300 structure using a color decoder 360. In accordance with a particular color mapping from RGB to RGBW, color data is provided to the shift register 320. Thus the color data includes values only for those primary color subpixels that are active for the mapping. Since the portions of the shift register 320 do not correspond to a unique particular primary color in a static manner, color data to be stored in the shift register are designated in FIG. 3 as CDATA_A, CDATA_B, and CDATA_C each stored respectively in first second and third shift register portions 321, 322, 323 of the shift register 320. Color data CDATA_A, CDATA_B, and CDATA_C are output from the shift registers 321, 322, 323, to respective decoders 341, 342, 343, each including a DAC for converting the digital color data CDATA_A, CDATA_B, and CDATA_C into respective analog decoder outputs, DOUT1 351, DOUT2 352, DOUT3 353.

In addition to color data for the three active primary colors, color bits are provided to the shift register 320 which determines which of the primary color subpixels each of the color data values, CDATA_A, CDATA_B, CDATA_C corresponds to. For example, for a particular color mapping, color bits would designate CDATA_A as data for the red subpixel, $CDATA_{13}$ B as data for the blue subpixel, and CDATA_C as data for the white subpixel. In FIG. 3 the color bits are illustrated as being provided to the driver 300 in a color bits portion 325 of the shift register 320. Alternatively the color bits can be provided with a separate shift register (not shown). In the case color bits is part of the main shift register 320, the bit mapping can be any combination as is apparent to persons of skill in the art. For example, in some cases, the color bits are assigned at the end (or beginning) of the shift register data for a pixel.

The color bits contain enough information for the color decoder 360 to determine how to switch the analog color data DOUT1, DOUT2, DOUT3, input to the color decoder 360, as outputs of the color decoder CDOUT1 371, CDOUT2 372, CDOUT3 373, CDOUT4 374, where each output of the color decoder CDOUT1, CDOUT2, CDOUT3, CDOUT4, corresponds to a respective primary color subpixel. These analog voltages output from the color decoder 360 are used to drive buffers 380 which include a respective buffer 381, 382, 383, 384 for each output of the color decoder 360. The drive buffers 381, 382, 383, 384 output drive signals DATA_C1, DATA_C2, DATA_C3, DATA_C4 which constitutes the primary color data which is provided to the pixel.

In some embodiments, rather than located after the color decoder 360, the buffers 380 can be located between the decoders 340 and the color decoder 360 to share the buffers between active outputs. In such a case the number of buffers is reduced to equal the number of decoders, which in this case is three.

In the example embodiment depicted in FIG. 3 a four-color sub-pixel pixel structure is contemplated. In this case, only three primary color subpixels are active at any one time for color point. Table 1 shows an example of the possible combinations of active primary color sub-pixels for a four-color sub-pixel structure, where colors A, B, and C are the three active subpixels and C1, C2, C3, and C4, are for example, R,G,B,W. It is obvious to an expert in the art that the combination of active colors can be different and can be in different coordination and correspond to different primary colors such as yellow, magenta, etc.

TABLE 1

An example of active color for a four-color sub-pixel

| Color A | Color B | Color C |
|---|---|---|
| C1 | C2 | C3 |
| C1 | C2 | C4 |

TABLE 1-continued

An example of active color for a four-color sub-pixel

| Color A | Color B | Color C |
|---|---|---|
| C1 | C3 | C4 |
| C2 | C3 | C4 |

As can be seen in table 1, there are four possible modes or combinations of three active primary color subpixels out of four primary subpixels per pixel. If every combination consists of S active subpixels from a total number of N primary color subpixels per pixel, the number of combinations is S-choose-N or S!/N!*(S−N)!, S≤N. In the case illustrated, since there are four possible modes or combinations, a 2-bit "color bits" would be sufficient to designate which of the four modes or combinations is applicable. In some cases, not every color mapping will require the same number of active primary color subpixels. For example it may be desired that for some colors only a mapping to two or even one primary color subpixel be applied. In such a case the number of possibilities may increase. For example, (R,G,W), (R,B,W), (G,B,W), (R,G,B), and (W) may be desired and as such they may form the preset states the color decoder will operate in. In other embodiments there may be a limited set of combinations such as (C1, C2, C3) and (C2, C3, C4) in which case the number of preset modes decreases. In this particular case with only two modes, a single bit "color bits" would suffice to convey to the color decoder 360 which combination is applicable. Generally speaking, the data driver and associated driving method contemplates any number of possible combinations for which only a subset of primary color subpixels of a pixel are used at any one time.

Figure 4:
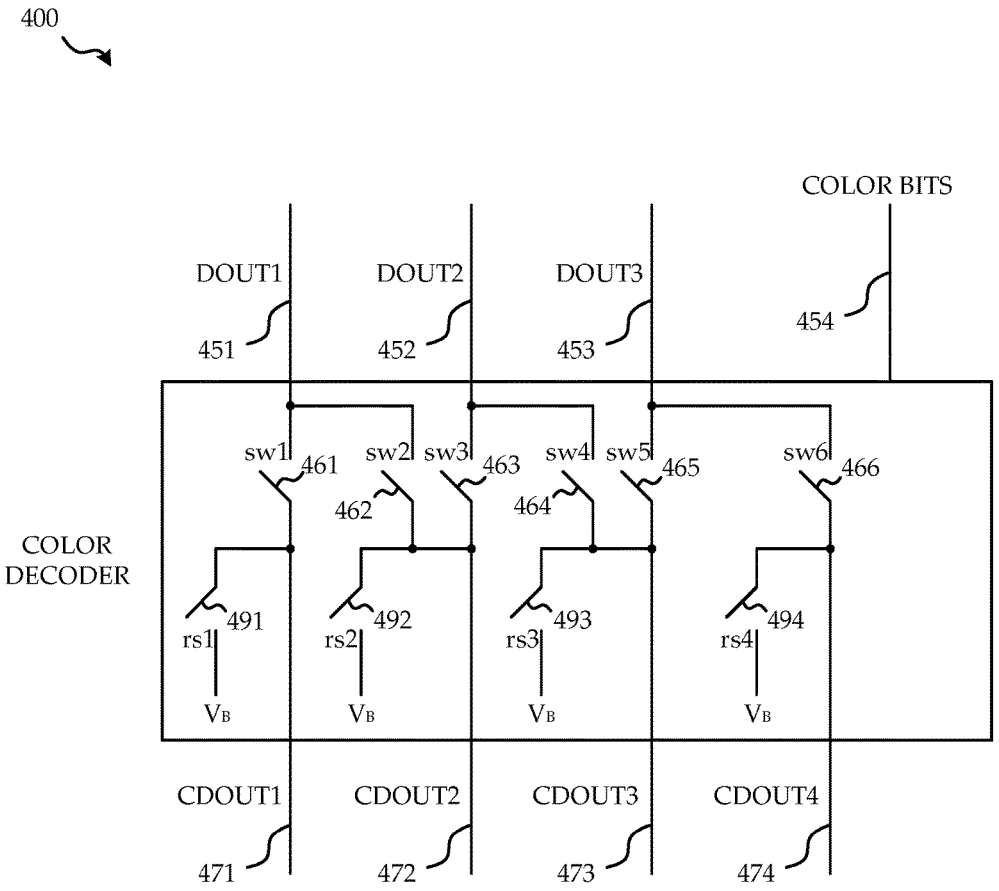
FIG. 4 illustrates a color decoder of a multiple color data driver according to an embodiment.

With reference also to FIG. 4, a color decoder 400 according to an embodiment will now be described.

The color decoder 400 takes as inputs 451, 452, 453, the analog color data DOUT1, DOUT2, DOUT3 output from the decoders, as well as color bits 454 input directly from the shift register.

The color decoder 400 includes a switch fabric having a number of switches for connecting particular inputs 451, 452, 453 of the color decoder 400 to particular color data outputs 471, 472, 473, 474 in accordance with the particular mode or combination as determined by the color bits 454, which is also referred to as a switch state. The switches of the switch fabric are used to enable different active outputs 471, 472, 473, 474 to be connected to particular inputs 451, 452, 453 from the decoders (hence the DACs). For example, in one case of "C1, C2, C3", the ON switches are sw1 461, sw3 463, and sw5 465 as well as reset switch rs4 494 to connect the output for C4 to a bias voltage. The inactive outputs are connected to a bias voltage "$V_B$". The bias voltage can be different for each output or it can be the same for all outputs. The result is that the active output color data CDOUT1 471, CDOUT2 472, CDOUT3 473, CDOUT4 474, if corresponding to an active primary color subpixel, includes the corresponding color data input to the color decoder 400 DOUT1, DOUT2, DOUT3, and if corresponding to a non-active subpixel, includes only a bias voltage "$V_B$".

Table 2 summarizes the states of the switches of the color decoder 400 depicted in FIG. 4 for driving the particular pixel combinations as summarized in Table 1.

TABLE 2

An example of color decoder functions.

| | sw1 | sw2 | sw3 | sw4 | sw5 | sw6 | rs1 | rs2 | rs3 | rs4 |
|---|---|---|---|---|---|---|---|---|---|---|
| C1, C2, C3 | ON | OFF | ON | OFF | ON | OFF | OFF | OFF | OFF | ON |
| C1, C2, C4 | ON | OFF | ON | OFF | OFF | ON | OFF | OFF | ON | OFF |
| C1, C3, C4 | ON | OFF | OFF | ON | OFF | ON | OFF | ON | OFF | OFF |
| C2, C3, C4 | OFF | ON | OFF | ON | OFF | ON | ON | OFF | OFF | OFF |

Each output of the color decoder 400 is coupled via a reset switch 491, 492, 493, 494, to a bias voltage or voltages, and two outputs of the color decoder are each couplable via the switches 462, 463, 464, 465 to more than one input of the color decoder. All the switches of the switching fabric 491, 492, 493, 494, 462, 463, 464, 465 are operated so that each output is coupled to only one of a voltage bias or one particular input at any one time.

It should be understood that there are a number of various possible configurations of switches in switch fabrics for switching the inputs of the color decoder 400 to the active outputs in accordance with the teachings above.

Referring once again to FIG. 3, generally each output of the color decoder 360 corresponding to a primary color subpixel which can be inactive is connected in the color decoder 360 via switch fabric to a bias voltage, and each output of the color decoder 360 corresponding to a primary color which can be active is couplable in the color decoder via switch fabric to one or more inputs of the color decoder 360. According to the switch state, each color output is coupled to only to a voltage bias or only to one input of the one or more inputs at any one time.

While particular implementations and applications of the present disclosure have been illustrated and described, it is to be understood that the present disclosure is not limited to the precise construction and compositions disclosed herein and that various modifications, changes, and variations can be apparent from the foregoing descriptions without departing from the spirit and scope of an invention as defined in the appended claims.

What is claimed is:

1. A color data driver for an emissive display system having pixels, each pixel having a number of primary color subpixels, each primary color subpixel having a light emitting device, the color data driver comprising:

data storage for receiving color data for a number of active primary color subpixels of a pixel, the number of active primary color subpixels less than a number of primary color subpixels of the pixel;

decoders for performing digital to analog conversion of the color data to generate analog color data, the number of decoders corresponding to a preset maximum number of active primary color subpixels of a pixel which is less than the number of primary color subpixels of the pixel; and a color decoder for receiving the analog color data for the number of active primary color subpixels and for providing the color data for the active primary color subpixels to the pixel, the color decoder comprising:

a switch fabric controllable to select a switching state being a combination of switching from color data inputs of the color decoder to color data outputs of the color decoder with use of color bits provided to the color decoder, the switch fabric for, according to the switching state, switching to each color data output one of at least one color data input, and for switching to at least one color data output, one of at least two color data inputs.

2. The color data driver of claim 1, wherein the switch fabric comprises a set of switches for connecting to at least one bias voltage, color data outputs which are not being used for providing to the pixel the color data for the active primary color subpixels.

3. The color data driver of claim 2 wherein the at least one bias voltage comprises a different bias voltage for each color data output.

4. The color data driver of claim 1, wherein the color bits uniquely identifies the switching state from a number of preset possible states, the bit length of the color bits corresponding to a shortest bit length required to select any of the switching states from the number of preset possible states.

5. The color data driver of claim 4 wherein the number of present possible states is two and the bit length of the color bits is one.

6. The color data driver of claim 1 wherein the number of active primary color subpixels is three, the preset maximum number of active primary color subpixels of a pixel is three, and the number of primary color subpixels of the pixel is four.

7. The color data driver of claim 6 wherein the primary color subpixels of the pixel consist of a red subpixel, a green subpixel, a blue subpixel, and a white subpixel.

8. The color data driver of claim 7, wherein the color bits uniquely identifies the switching state from four preset possible states and the bit length of the color bits is two, and wherein the switch fabric comprises a set of switches for connecting to at least one bias voltage, color data outputs which are not being used for providing to the pixel the color data for the active primary color subpixels.

9. The color data driver of claim 1, wherein the color decoder receives the analog color data from the decoders via buffers, the number of buffers corresponding to the number of decoders.

10. The color data driver of claim 1, wherein the data storage comprises a switch register for storing the color data and the color bits, and for providing the color bits to the color decoder.

11. A method of data driving for an emissive display system having pixels, each pixel having a number of primary color subpixels, each primary color subpixel having a light emitting device, the method comprising:

receiving color data for a number of active primary color subpixels of a pixel, the number of active primary color subpixels less than a number of primary color subpixels of the pixel;

performing digital to analog conversion of the color data to generate analog color data using decoders, the number of decoders corresponding to a preset maximum number of active primary color subpixels of a pixel which is less than the number of primary color subpixels of the pixel;

receiving by a color decoder the analog color data for the number of active primary color subpixels; and providing by the color decoder the color data for the active primary color subpixels to the pixel with use of a switch fabric, the providing comprising:

selecting a switching state being a combination of switching from color data inputs of the color decoder to color data outputs of the color decoder with use of color bits provided to the color decoder;

according to the switching state, switching to each color data output one of at least one color data input; and according to the switching state, switching to at least one color data output, one of at least two color data inputs.

12. The method of claim 11, wherein the step of providing further comprises:

according to the switching state, connecting to at least one bias voltage, color data outputs which are not being used for providing to the pixel the color data for the active primary color subpixels.

13. The method of claim 12 wherein the at least one bias voltage comprises a different bias voltage for each color data output.

14. The method of claim 11, wherein the color bits uniquely identifies the switching state from a number of preset possible states, the bit length of the color bits corresponding to a shortest bit length required to select any of the switching states from the number of preset possible states.

15. The method of claim 14 wherein the number of present possible states is two and the bit length of the color bits is one.

16. The method of claim 11 wherein the number of active primary color subpixels is three, the preset maximum number of active primary color subpixels of a pixel is three, and the number of primary color subpixels of the pixel is four.

17. The method of claim 16 wherein the primary color subpixels of the pixel consist of a red subpixel, a green subpixel, a blue subpixel, and a white subpixel.

18. The method of claim 17, wherein the color bits uniquely identifies the switching state from four preset possible states and the bit length of the color bits is two, and wherein the step of providing further comprises:

connecting to at least one bias voltage, color data outputs which are not being used for providing to the pixel the color data for the active primary color subpixels.

19. The method of claim 11, wherein the receiving by the color decoder of the analog color data from the decoders is via buffers, the method further comprising:

receiving by buffers the analog color data from the decoders, the number of buffers corresponding to the number of decoders.

20. The method of claim 11, further comprising:

storing the color data and the color bits in a switch register; and providing the color bits from the switch register to the color decoder.

* * * * *